United States Patent [19]

Sato et al.

[11] 4,289,806

[45] * Sep. 15, 1981

[54] PRESSURE-SENSITIVE RECORDING MATERIAL

[75] Inventors: Atsushi Sato, Tokyo; Isoo Shimizu, Yokohama; Eiichi Matsuzaka, Tokyo, all of Japan

[73] Assignee: Nippon Petrochemicals Company, Limited, Tokyo, Japan

[ * ] Notice: The portion of the term of this patent subsequent to Mar. 13, 1996, has been disclaimed.

[21] Appl. No.: 114,994

[22] Filed: Jan. 24, 1980

[30] Foreign Application Priority Data

Jan. 27, 1979 [JP] Japan ..... 54-7689
Jan. 27, 1979 [JP] Japan ..... 54-7690

[51] Int. Cl.[3] ..... B41M 5/16; B41M 5/22

[52] U.S. Cl. ..... 427/150; 282/27.5; 427/151; 427/180; 428/307; 428/537; 428/914

[58] Field of Search ..... 106/21; 282/27.5; 427/151, 152, 150, 180; 428/307, 537, 913, 914; 208/46, 71, 139, 256, 257; 585/25, 422

[56] References Cited

U.S. PATENT DOCUMENTS

| | | | |
|---|---|---|---|
| 3,836,383 | 9/1974 | Kiritani et al. | 282/27.5 X |
| 3,936,566 | 2/1976 | Sato et al. | 428/323 |
| 4,144,279 | 3/1979 | Sato et al. | 208/139 X |
| 4,181,328 | 1/1980 | Satomura et al. | 282/27.5 |

*Primary Examiner*—Bruce H. Hess
*Attorney, Agent, or Firm*—Scully, Scott, Murphy & Presser

[57] ABSTRACT

A pressure-sensitive recording material which is excellent in several properties and prepared at a low cost. The pressure-sensitive recording material of the invention is applied with pressure-rupturable microcapsules containing a solution of dyestuff in a solvent fraction having a boiling range of 265° C. to 360° C. (converted to atm. press.) which is obtained by treating a raw material fraction in the presence of an acid catalyst. The raw material fraction is obtained from the product of thermal cracking of petroleum hydrocarbons at a temperature of 700° C. or above and mainly contains the distillate having boiling points in the range of 75° C. to 198° C. and the main components thereof are monocyclic aromatic hydrocarbons (excluding aromatic olefins) and monocyclic aromatic olefins.

12 Claims, No Drawings

PRESSURE-SENSITIVE RECORDING MATERIAL

BACKGROUND OF THE INVENTION

1. Field of the Invention

This invention relates to a pressure-sensitive recording material. More particularly, the invention relates to a pressure-sensitive recording material which is applied with microcapsules containing a solution of dyestuff or coloring agent in a heavy fraction of distillation. The heavy fraction is obtained by treating a raw material fraction in the presence of an acid catalyst and the above raw material fraction is obtained by the thermal cracking of petroleum hydrocarbons.

2. Description of the Prior Art

Several kinds of pressure-sensitive recording materials are hitherto well known. For example, a sheet of paper is applied with microcapsules containing a solution of a colorless dyestuff and another sheet of paper is applied with clay or polymeric material which produces a color by reacting with the dyestuff. When the recording materials are used, the treated surfaces of the above sheets are put together face to face and local pressure is applied to the paired papers by hand writing or typewriting, thereby obtaining desired duplicate impressions.

The recording mechanism in the pressure-sensitive recording material of the type described above is such that the microcapsules are ruptured by the pressure of hand writing or the impacts of typewriting to release the coloring dyestuff solution from the microcapsules. The dyestuff solution contains a coloring agent as an electron donor dyestuff and comes into contact with the clay or polymeric material as an electron acceptor on the opposing surface of the other sheet of paper, thereby producing a color.

In another type of known recording material, the microcapsule layer is applied on one side of a sheet of paper as an inner layer and the clay or polymeric material is then applied an an outer layer over the microcapsule layer. Similarly, when it is used, the microcapsules on this recording material are ruptured by the pressure of hand writing or typewriting and the coloring solution containing a dyestuff is released from the microcapsules, the coloring solution coming into contact with the clay or the polymeric material in the outer layer, thereby producing a color.

The coloring solution that is used for these recording materials is a solution of a colorless dyestuff of an electron donor in one or more kinds of hydrophobic solvents. This hydrophobic solvent is required to have the following properties.

That is, the solvents must have the properties of: innoxiousness, no disagreeable odor, colorless or quite light color, non-volatility, good dissolving power with dyestuffs and good stability when a dyestuff is dissolved. It is further required that, in the preparation of microcapsules, a very fine and stable disperesion of the solution can be produced; microcapsule membranes can be formed around the fine particles of the dispersion; the obtained microcapsules have good storage stability; the membranes of microcapsules are uniform and of desired thickness; the solvent does not inhibit the color-producing reaction between a dyestuff and clay or a polymeric material with a high reaction rate; the solvent dissolved the polymeric material to cause close contact with the dyestuff when the base paper is coated with the polymeric material; the duplicate impression is clear without runs; and that the duplicate impression can be maintained as it stands for a long period of time without any change.

In the prior art, polychlorinated biphenyl was widely used as the solvent for producing the microcapsules of these pressure-sensitive recording material. The polychlorinated biphenyl has indeed several excellent properties as the solvent of this kind. It has, however, a serious disadvantage in that it is quite toxic to health and its accumulation in the human body can cause several disorders. Therefore, when the recording material having a microcapsule layer containing the polychlorinated biphenyl is handled in the production process and used in recording, it gives serious problems. Accordingly, it is required that the solvent dissolves dyestuffs well, has excellent properties for the microcapsule preparation and is non-toxic.

Among solvents which meet such requirements, the already proposed desirable ones are non-condensed bicyclic aromatic hydrocarbons, that is, diaryl alkanes, which are disclosed in U.S. Pat. No 3,836,383 (Kiritani et al.), British Pat. No. 1,406,107 (Monsanto Co.) and U.S. Pat. No. 3,936,566 (Sato and Shimizu, both are the inventors of the present invention, and another person).

In the above prior art references, the methods for preparing the solvents are disclosed, in which styrenes or benzyl chloride is caused to react with alkylbenzenes, or formaldehyde is caused to react with alkylbenzenes. In these preparation methods, any of the styrenes, benzyl chloride and formaldehyde are expensive materials which must be produced by synthesis. Further, the alkylbenzenes are also expensive since they are also produced by synthesis or aromatic group extraction. Therefore, these methods are not satisfactory for providing inexpensive solvents.

SUMMARY OF THE INVENTION

The inventors of the present application have disclosed "Method of Processing Thermal Cracked By-Product Oil" in commonly assigned U.S. Pat. No 4,208,268 and the same processing method by using a novel catalyst in U.S. Pat. No. 4,144,279.

The products which are obtained through these methods include non-condensed bicyclic and tricyclic aromatic hydrocarbons and other aromatic hydrocarbons. It has been determined that among the above products, the fractions within a certain boiling range are quite suitable as the solvents for the pressure-sensitive recording material.

It is, therefore, the primary object of the present invention to provide a pressure-sensitive recording material which is produced by using quite inexpensive solvents. The solvents are produced by using a thermal cracking fraction itself as the raw material for synthesis. The above thermal cracking fraction is the one which has been used as the raw material for obtaining gasoline or for the extraction of aromatic hydrocarbons.

Another object of the present invention is to provide a pressure-sensitive recording material which is excellent in color developing speed and gives clear and distinct duplicate images. Further, the solvent used for preparing the recording material is excellent in dissolving coloring dyestuffs.

A further object of the present invention is to provide a pressure-sensitive recording material which does not contain any solvent having toxicity such as that of the polychlorinated biphenyl.

According to the present invention, the pressure-sensitive recording material of the present invention is applied with pressure-rupturable microcapsules, containing therein a solution of dyestuff in a solvent fraction having a boiling range (converted to atmospheric pressure) of 265° C. to 360° C., which is obtained by treating a raw material fraction in the presence of an acid catalyst and under the conditions of liquid phase, 0.1 to 5 hours in contact time, and 10% by weight or less in the concentration of monocyclic aromatic olefins that is contained in the material fed to the reaction vessel. The above raw material fraction is obtained from the product of thermal cracking of petroleum hydrocarbons at a temperature of 700° C. or above, and mainly contains the distillate having the boiling points in the range of 75° C. to 198° C., and the main components thereof are monocyclic aromatic hydrocarbons (excluding aromatic olefins) and monocyclic aromatic olefins.

DETAILED DESCRIPTION OF THE INVENTION

The raw material fraction that is used in the present invention is a fraction which is obtained from the product of thermal cracking of petroleum hydrocarbons at a temperature not lower than 700° C. This raw material fraction mainly contains the distillate having boiling points in the range of 75° C. to 198° C. and is composed of the main components of monocyclic aromatic hydrocarbons (excluding aromatic olefins) and monocyclic aromatic olefins having boiling points in the above range.

The above raw material fraction comprises the by-product fraction of 75° C. to 198° C. obtained in the thermal cracking of petroleum hydrocarbons such as crude oil, naphtha, gas oil, kerosene, L.P.G. and butane, at 700° C. or above. The composition of such the fraction differs according to the kind of petroleum hydrocarbon that is used for the thermal cracking. The fraction which is used as the raw material for the present invention comprises the main components of monocyclic aromatic hydrocarbons each having 6 to 10 carbon atoms as well as 5 to 15% by weight of saturated aliphatic hydrocarbons, 2 to 10% by weight of unsaturated aliphatic hydrocarbons and 2 to 15% by weight of aromatic olefins.

The above fraction in the boiling range of 75° C. to 198° C. that is obtained from the thermal cracking of petroleum hydrocarbons at 700° C. or above, contains monocyclic aromatic hydrocarbons such as benzene, toluene, xylene, isopropylbenzene, n-propylbenzene, methylethylbenzene, trimethylbenzene, diethylbenzene and tetramethylbenzene. These monocyclic aromatic hydrocarbons are caused to react with other components of olefins (unsaturated aliphatic hydrocarbons and monocyclic aromatic olefins) in the presence of acid catalyst, thereby producing the main constituents of heavy components having the boiling range of 265° C. to 360° C. (converted to atm. press.), which are useful as the solvent for the dyestuffs. These heavy components are the mixture of various kinds of aromatic hydrocarbons. That is, by using the raw material hydrocarbons containing aromatic olefins or styrene, α-methylstyrene, vinyltoluene and ethylstyrene and so forth, the heavy reaction products of non-condensed bicyclic and/or tricyclic aromatic hydrocarbons, which are necessary for the solvent of dyestuffs in the present invention, are produced.

There is no special limitation with respect to the quantities of monocyclic olefins in the raw material fraction. It is, however, desirable that the molar ratio of monocyclic aromatic hydrocarbons (excluding monocyclic aromatic olefins) to the monocyclic aromatic olefins be in the range of 1:0.05–1:1. If the ratio of monocyclic aromatic olefins is less than 0.05, the solvent fraction decreases. While, if the ratio is more than 1, the unsaturated polymers of the monocyclic aromatic olefins are over-produced and come into the solvent fraction and degrade the property as the solvent.

It is not desirable that the raw material fraction contain the components having boiling points of above 200° C., such as the condensed polycyclic aromatic hydrocarbons of naphthalene, alkylnaphthalene and anthracene. Since these polycyclic aromatic hydrocarbons have many carbon atoms which are active to alkylation, when the raw material containing these components are used, heavy products are produced by polyalkylation, this is undesirable because the yield of the solvent of the present invention becomes low. Meanwhile, the fraction of the boiling point lower than 75° C. obtained from the thermal cracking of petroleum oil contains many dienes such as cyclopentadiene. When such dienes are contained in the raw material, the polymerization of dienes occurs and much viscous material is produced. Then, the reaction in the presence of acid catalyst is inhibited and the yield of solvent is severely reduced to undesirable levels.

It is better that the raw material reaction contain the main components having boiling points in the range of 105° C. to 180° C. This fraction contains monocyclic aromatic hydrocarbons (excluding aromatic olefins) such as xylenes, ethylbenzene and $C_9$-aromatic hydrocarbons, and monocyclic aromatic olefins such as styrene, α-methylstyrene and vinyltoluenes. By using this as the raw material fraction, the yield of solvent fraction of the objective product can be raised, and the dissolving power of the solvent fraction to dyestuffs becomes good.

As the raw material fraction, the boiling point is more preferably in the range of 135° C. to 160° C. This fraction contains xylenes and ethylbenzene as the monocyclic aromatic hydrocarbons (excluding aromatic olefins) and styrene as the monocyclic aromatic olefin. When the solvent fraction of the objective product is produced from this fraction, the yield of the solvent fraction is much higher and the dissolving power of the solvent fraction to dyestuffs becomes greater.

In the preparation of the solvent fraction of the present invention, when the above raw material fraction is used, it is not necessary to separately prepare the monocyclic aromatic olefin, such as expensive styrene and to cause it to react with other raw material. Therefore, the present invention is advantageous in that the objective solvent fraction can be obtained with a high yield by utilizing only the monocyclic aromatic olefins that are contained in the raw material fraction. Accordingly, the solvent in the present invention can be prepared quite inexpensively as compared with those produced by the prior art methods in which aromatic olefines and xylenes are separately prepared and caused to react with each other as described in U.S. Pat. No. 3,936,566 (Sato et al.) and U.S. Pat. No. 3,836,383 (Kiritani et al.).

Further, the present invention is quite advantageous in that the raw material fraction which has been of less utility value as it stands in the prior art, can directly be used as the reaction material and a valuable solvent can be obtained.

The acid catalysts that are preferably used in the present invention are solid acid catalysts, mineral acids and the co-called Friedel-Crafts catalysts. For example, there are acidic clay minerals such as acid clay and activated clay, hydrogen fluoride, sulfuric acid, phosphoric acid, aluminum chloride, tin chloride and boron fluoride. Exemplified as the preferably used solid acid catalysts are natural clay minerals. The clay minerals are typically exemplified by kaolin group halloysite clay minerals and montmorillonite group clay minerals which are known as acid clay and subbentonite. Furthermore, the above-mentioned clay mineral such as activated clay which is treated with an inorganic acid such as sulfuric acid or hydrochloric acid, an organic acid such as acetic acid or formic acid, or their aqueous solution, can also be used. Still further, besides the natural clay minerals, synthetic silica-alumina can also be used as a preferable solid catalyst. Even though inorganic acids such as sulfuric acid, phosphoric acid and hydrogen fluoride can also be used, it is necessary to give consideration to the corrosion of reaction apparatus.

Further, an especially desirable catalyst is the above synthetic silica-alumina which is prepared by calcining at a temperature of 450° C. to 600° C. and contains 20% to 50% by weight of alumina. The synthetic silica-alumina that is used in the preparation of the solvent according to the present invention is a high-alumina synthetic silica-alumina which is represented by the general formula: $Al_2O_3.(SiO_2)_n.mH_2O$ wherein n is a numeral defined by the equation: $1.70 \leqq n < 6.79$, and the content of alumina is in the range of 20% to 50% by weight.

The silica-alumina that is used in this invention is characterized in that it is calcined at a specific high temperature and contains much alumina. Accordingly, the calcination of the catalyst is an important factor in the present invention. It is sufficient that the calcination is carried out at a temperature from 450° C. to 600° C. for more than 4 hours. The calcination may well be carried out in air and the use of an inert gas is not needed.

The calcination temperature below 450° C. will give rise to no improvement in the life of catalytic activity, while, the calcination conducted at a temperature above 600° C. will disadvantageously cause the reduction of catalytic activity due to sintering. Further, during the calcination, it is desirable that the silica-alumina not be heated above 600° C. even locally. In this heat treatment, the coexistence of moisture is not desirable as it will considerably promote sintering which causes the reduction of the catalytic activity. It is, therefore, preferable to dry the silica-alumina at a temperature from 150° C. to 200° C. prior to the calcination.

The synthetic silica-alumina that is used in the present invention may be prepared by any of the conventional methods such as deposition method, coprecipitation method and blending method. For example, as described in U.S. Pat. Nos. 2,384,946 and 2,900,349 it is prepared by the method in which silica-alumina gel is prepared by adding an aqueous solution of aluminum sulfate to a slurry of silica hydrogel that is obtained by slightly acidifying an aqueous solution of sodium silicate. The content of alumina can easily be controlled by adjusting the quantity of the aluminum salt added.

In the reaction in the presence of an acid catalyst, it is necessary to maintain the raw material fraction in a liquid state. Accordingly, if necessary, an adequate pressure must be applied to the reaction system in order to maintain the raw material fraction in a liquid state at a predetermined reaction temperature.

If a gas phase exists in reaction system, the polymerization of styrene is promoted on the catalyst that is exposed to the gas phase, which results in the lowering of styrene yield and, at the same time, reducing the life of this catalyst because the surfaces of catalyst are covered by the polymerization product. The pressure of the reaction system depends upon the composition of raw material fraction and the level of reaction temperature. It is, however, not higher than 40 $Kg/cm^2$ and preferably in the range of 3 $Kg/cm^2$ to 10 $Kg/cm^2$. That is to say, the pressure is not an essential factor in the present invention but only it is necessary to maintain the liquid state of raw material fraction at a reaction temperature.

The reaction temperature in the present invention is preferably in the range of 0° C. to 200° C. When the reaction temperature is below 0° C., the polymerization of styrenes, as the unsaturated components contained in the cracked oil, occurs and a tar-like substance is produced which undesirably results in the lowering of the yield of solvent fraction. On the contrary, if the reaction temperature is higher than 200° C., the properties of solvent fraction become worse due to thermal decomposition. The reaction temperatures are different according to the kind of catalyst used. The desirable reaction temperature for the solid acid catalyst is 100° C. or above, for mineral acids and Friedel-Crafts catalyst, 100° C. or below, and for the above-described synthetic silica-alumina, 100° C., preferably in the range of 140° C. to 180° C. In the case of silica-alumina, the reaction temperature below 100° C. will cause undesirable polymerization of monocyclic aromatic olefins.

The contact time of the reaction is preferably in the range of 0.1 hour to 5 hours. If the contact time is shorter than 0.1 hour, the reaction of the unsaturated components, which mainly consists of monocyclic aromatic olefins in the raw material fraction, is not completed and the yield of useful solvent is reduced. On the contrary, when the reaction material is brought into contact with the catalyst for more than 5 hours, the decomposition of reaction product occurs and the quantity of undesirable unsaturated components is increased. Therefore, the properties of solvent become worse.

In order to obtain the solvent fraction with good yield, the quantity of monocyclic aromatic olefins, contained in the raw material that is fed into a reaction vessel, is preferably restricted to 10% by weight or less. When the content of monocyclic aromatic olefins and other unsaturated components, in the supplied reaction material is too high, the amount of heavy tar will increase due to the polymerization of unsaturated components, and the yield of solvent fraction is reduced. In addition, unsaturated polymers are produced, and they are introduced into the objective solvent fraction. Therefore, the properties of the solvent fraction become worse. The fraction obtained from the thermal cracking process having the above-described boiling range generally contains more than 10% by weight of aromatic olefins. In practice, it is desirable that the concentration of monocyclic aromatic olefin components be adjusted by recycling the reaction product or by recycling the unchanged fraction (of the same boiling range as the raw material fraction) which has been recovered from the reaction product by distillation. However it is not desirable to adjust the concentration of monocyclic aromatic olefins by using a solvent, as a diluent, such as an aliphatic hydrocarbon or halogenated hydrocarbon which is inert to the reaction. When the reaction system contains the component that is inert to the reaction, the unsaturated linear dimerization or cyclic dimerization of the monocyclic aromatic olefin is promoted and that product is retained in the solvent fraction, degrading the properties of the objective solvent.

The foregoing raw material fraction is treated with the acid catalyst under the above-described conditions to produce reaction product. The material that is used as the solvent in the present invention is the fraction having the boiling range of 265° C. to 360° C. (converted to atm. press.). The fraction in this boiling range is a mixture of heavy aromatic hydrocarbons containing, as the main components, non-condensed bicyclic aromatic hydrocarbons which are produced by the acid catalyst treatment of the raw material fraction. The solvent fraction has excellent solvent characteristics as compared with any of the conventional mineral oil and aromatic hydrocarbons such as alkylbenzene, diphenylalkane and alkylnaphthalene.

The fraction containing the components of higher than 360° C. in boiling point is viscous, and the dissolving power and color-developing speed with respect to coloring dyestuffs are not good. Further, the high boiling fraction has less fluidity at low temperatures so that it is not desirable when the final product of pressure-sensitive recording materials is to be used in cold districts. Meanwhile, if the components having boiling points of below 265° C. are contained in the solvent, the work safety during the production of pressure sensitive recording materials is poor because the flash point becomes low. Further, the odor is undesirable. Therefore, the preferable boiling range (converted to atm. press.) of the solvent fraction is 275° C. to 315° C., since that fraction contains the non-condensed bicyclic aromatic hydrocarbons as the main components.

The main components of the above solvent fraction are the so-called asymmetric type in which a benzene ring has an alkyl substituted group or groups on only one side. Further, included in the bicyclic aromatic hydrocarbons is the compound which has a structural characteristic that the alkane between the two benzene rings is 1,1-substituted ethane and it is connected to the benzene ring through a tertiary carbon atom. The compound has an advantage as compared with other diphenylalkane compounds due to this structural characteristics. That is, the asymmetric diphenylalkane having an alkyl group on a benzene ring on one side has better dissolving power relative to dyestuffs compared with the symmetrical diphenylalkane having alkyl groups on both benzene rings. Further, as compared with the diphenylalkane which has methane or a secondary carbon atom such as 1,2-substituted ethane and the diphenyl alkane which has a quaternary carbon atom as that of 2,2-substituted propane, the above-mentioned diphenylalkane, in which the alkane between benzene rings is 1,1-substituted ethane and a tertiary carbon atom is contained, is excellent in innoxiousness as well as in the color density and durability after color development. The innoxiousness depends upon the fact that the compound having the tertiary carbon atom is biochemically decomposed more easily.

Furthermore, the solvent according to the present invention is superior to any other conventional hydrocarbon solvents which do not contain chlorine. The dissolving power of alkylbenzene, naphthene and paraffin to dyestuffs is not good.

Although the petroleum fraction (e.g. boiling point: 135° C. to 260° C.) containing aromatic hydrocarbons has hitherto been proposed, it is not good enough since it has disagreeable odor, low dissolving power to dyestuffs and low color developing speed. The polycyclic aromatic hydrocarbons such as alkylbiphenyl, partially hydrogenated terphenyl, and alkylnaphthalene are low in color developing speeds as compared with the solvent of the present invention.

The solvent of the present invention is quite excellent because it is non-toxic, unlike chlorinated biphenyl, has no disagreeable odor and has several other desired properties. In addition, the solvent of the invention has a high boiling point and is non-volatile so that the microcapsules can be preserved for a long time after the preparation. When the solvent is used, generally 1 to 7%, preferably 3 to 5%, of a dyestuff is dissolved into the solvent, at which the solvent of the present invention has sufficient dissolving power for the material to be dissolved. Examples of the dyestuffs that are used for the pressure sensitive recording material of the invention are diarylphthalide, leucauramine, acyluramine, $\alpha,\beta$-unsaturated arylketone, basic monoazo dye, Rhodamine B lactam such as N-(p-nitrophenyl) Rhodamine B lactam, polyaryl carbinol and 8′-methoxy benzoindolino spiropyran (represented as "8′methoxy BISP").

These dyestuffs are electron donative ones, while the applying layer is composed of an electron acceptor of clay or polymeric substance which is brought into direct contact with the dyestuffs. Examples of the above polymeric substance are phenol-aldehyde polymer, phenol-acetylene polymer, maleic acid-rosin polymer, partially or completely hydrolyzed styrene-maleic anhydride copolymer, partially or completely hydrolyzed ethylene-maleic anhydride copolymer, carboxy polyethylene and partially or completely hydrolyzed vinyl methyl ether-maleic anhydride copolymer.

As the method to prepare the microcapsules from the coloring dyestuff solution, which is formed by dissolving a dyestuff into the solvent of the invention, there is a coacervation method in which the fine particles of the dyestuff solution dispersed in water are coated by protective colloidal material such as gelatine or gum arabic, thereby obtaining the microcapsules which contain the dyestuff solution. Another method is the interfacial polymerization method in which monomer, intermediate or partially condensed product is employed and a polymerization initiator, an accelerator or a catalyst is added to cause the polymerization on the surfaces of fine particles of the dyestuff solution, thereby preparing the microcapsules containing the dyestuff solution. The solvent of the present invention can be used in both of the above methods. In the practical process for preparing the microcapsules in the conventional art, an auxiliary solvent has been used, in addition to chlorinated biphenyl, in dissolving a dyestuff in order to control the viscosity and volatility of the dyestuff solution, the particle size of the fine dispersion in microcapsule formation, the solubility to the polymeric material that is coated on the surface to be recorded and the rate of color development. However, the solvent of the present invention can be used satisfactorily without such an auxiliary solvent. Nevertheless, a solvent which does not worsen the characteristics of the solvent of the present invention, may be used as an auxiliary solvent as long as it is not more than 2 parts by weight relative to 1 part by weight of the solvent of the invention. That is, a proper quantity of diarylalkanes, partially hydrogenated terphenyls, alkyl naphthalenes, alkyl biphenyls or other known solvents can be added to the solvent of the invention.

In order that those skilled in the art may better understand the present invention and the manner in which it may be practised, the following specific examples are given.

EXAMPLE 1

(a) Preparation of Solvent

A 10 liter autoclave was fed with 1 liter of thermal cracking by-product oil and 100 g of acid clay, and it was pressurized to 30 Kg/cm$^2$ with nitrogen. The above by-product oil was obtained from the thermal cracking of petroleum oil for obtaining ethylene and had an initial distillation point of 68° C., 97% distillate temperature of 175° C., 94.6% by weight of the components having a boiling range of 75° C. to 198° C., and the composition of 13.7% of saturated aliphatic components, 68.5% of aromatic components and 17.8% of olefins. The above materials were heated to 150° C. with stirring and maintained at this temperature. It is desirable that, when the observed temperature of heat of reaction rises rapidly at about 110° C., the heating be temporarily stopped. Then, 5 more liters of the above-mentioned by-product oil were added dropwise over 3 hours. After the addition, the heating with stirring was continued for another hour.

After cooling, the acid clay was separated by filtration. After 3.65 kg of light fraction up to 190° C. in distillation temperature was recovered at the atmospheric pressure, the fractions shown in the following Table 1 were separated by reduced pressure distillation at 3 mmHg.

TABLE 1

| Fraction | Distillation temp. range (3 mmHg, °C.) | Temp. conv'd. to atm. press. (°C.) | Yield (g) | Remarks |
|---|---|---|---|---|
| 1 | 60–110 | 195–265 | 340 | Solvent of |
| 2 | 110–185 | 265–340 | 850 | the present |
| 3 | 185–240 | 340–425 | 240 | invention |
| 4 | — | — | 140 | Bottom residue |

Since the fraction 1 has odor and a low flash point, it is not desirable for the pressure sensitive recording material. Fraction 3 is also undesirable because the dissolving power to dyestuffs is low, and the pour point and the viscosity are high, which causes the difficulties in the releasing of dyestuff solution from microcapsules in cold districts and the lowering of color developing speed.

Though the solvent of the present invention has a low viscosity as compared with those of other hydrocabon solvents, the flash point of the former solvent is relatively low. This fact is quite desirable in view of the work efficiency and safety in the microcapsule preparation.

(b) Preparation of Microcapsules

Microcapsules were prepared through coacervation method with using the solvent fraftion 2 that was obtained in the foregoing Procedure (a).

In this example, crystal violet lactone (C.V.L.) was used as the coloring dyestuff. A mixed solvent was prepared by mixing 3 parts by weight of the above-mentioned solvent fraction and 1 part by weight of an auxiliary solvent of kerosene (trademark: Nisseki No. 3 Ink Oil, made by Nippon Petrochemicals Co., Ltd.). A dyestuff solution was prepared by adding 3% of C.V.L. to the above mixed solvent. A blender was fed with 1% by weight aqueous solution of polyvinyl methyl ether-maleic anyhdride copolymer and 11% aqueous sol of gelatine. The above dyestuff solution was then added into the blender and the operation of the blender was continued until fine dispersion particles smaller than about 5 microns in diameter were obtained. The mixing ratio of the above was 60 parts by weight of the copolymer, 136 parts by weight of the gelatine sol and 187 parts by weight of the dyestuff solution.

To the above obtained emulsified mixture were added 91 parts by weight of an aqueous solution of gum arabic and 725 parts by weight of water with stirring, which was followed by pH adjustment to about 9.0 with adding 10% by weight aqueous solution of sodium hydroxide. In the next step, 10% acetic acid solution was added little by little until the pH value reached 4.6, thereby separating out the coacervate and depositing it around the fine dispersion particles. After this procedure of microcapsule formation, the membranes of microcapsules were cured by adding a glutaraldehyde solution to complete the microcapsule preparation. Through the above procedure, quite good microcapsules were obtained which were not interior to the conventional ones that are prepared by using chlorinated biphenyl.

(c) Preparation of Pressure-Sensitive Recording Paper

The microcapsules obtained in the above Procedure (b) were used to coat one surface each of two sheets of Paper A. One side of Paper B was coated with clay, and one side of Paper C was coated with phenol-aldehyde copolymer. Then, the surfaces of Paper A coated with the microcapsules were opposed to the coated surfaces of Papers B and C. Each uncoated surface of Paper A was applied with local pressure by hand writing, thereby producing blue images on the coated surfaces of Papers B and C. The produced lines were clear without run and the speed of color development was satisfactorily high.

EXAMPLE 2

According to the following procedure, a solvent was prepared using the same by-product oil from Example 1. 90% sulfuric acid was used as an acid catalyst and 0.5 liter of the light fraction obtained in Example 1 was used as an initial diluent.

A 10 liter reaction vessel, equipped with a stirrer and a thermometer, was fed with the above diluent and 200 g of 90% sulfuric acid, and the contents of the reaction vessel were cooled to within 7°–12° C. Continuing the cooling, to keep the contents below 15° C., 5 liter of the by-product oil was added dropwise for 3 hours. After the addition, the stirring was continued for 30 minutes more.

After the reaction, the reaction mixture was neutralized and washed with water and 3.2 kg of light fraction, up to 190° C. in distillation temperature at atmospheric pressure, was recovered. Then, 0.76 kg of a solvent fraction, of the boiling range of 120° C. to 160° C. (280° C. to 330° C. as converted to atm. press.), was obtained by reduced pressure distillation at 3 mmHg. The properties of this fraction, such as toxicity, odor, hue, dissolving power to dyestuffs and stability of solution, were satisfactory. The microcapsules were prepared in a manner similar to Procedures (b) and (c) of Example 1, and some sheets of recording paper were prepared. The sheets of recording paper were put together in layers, and duplication was carried out using a ballpoint pen. A clear duplicate without any run was obtained.

EXAMPLE 3

By using 10 g of anhydrous aluminum chloride as an acid catalyst and at a reaction temperature of 50° C. to 55° C., 0.68 kg of solvent fraction was prepared in a manner similar to Example 2. The toxicity, odor, hue, dissolving power to dyestuffs and stability of solution of this fraction were also satisfactory. Microcapsules were prepared similar to Procedures (b) and (c) of Example 1, using the above solvent fraction but without using the auxiliary solvent. Sheets of recording paper were prepared which gave clear duplicate images without run.

EXAMPLE 4

Example with Synthetic Silica-Alumina Catalyst (a) Preparation of Catalyst

Dissolved in water was 168.8 g of sodium silicate of the weight ratio of silica: sodium oxide of 2.9 (JIS No. 3), to prepare 2 kg of sodium silicate aqueous solution. While maintaining the solution at a temperature of 35°±1° C. with vigorous stirring, 70 g of 40% sulfuric acid was added over a period of about 60 minutes. Cooling was required in order to maintain the temperature of 35°±1° C. throughout the addition of sulfuric acid. After this addition, stirring was continued for 2 additional hours for aging. Then, a 20% by weight aqueous solution of aluminum sulfate was added with stirring over a period of 90 minutes. Amounts of the aqueous aluminum sulfate solution to be added corresponded to the alumina content of the desired silica-alumina, the amounts being 490.4 g and 840.6 g respectively for the alumina contents of 28% by weight and 40% by weight.

After the addition of aluminum sulfate solution, the resulting solution was adjusted to pH 8.0 to 8.5 by the addition of 15% aqueous ammonia. The slurry was then stirred for about 30 minutes for aging. The slurry was then filtered off and washed with 2% aqueous solution of $NH_4Cl$. The filtration and the washing were repeated until the filtrate becomes neutral. The slurry filter cake was dried at 200° C. for 8 hours and pulverized to particle sizes equivalent to 5 to 10 mesh screen.

In this and the following comparative examples two catalysts of alumina contents of 28% by weight and 40% by weight were used. They were expressed as $Al_2O_3$-28 and $Al_2O_3$-40, respectively.

(b) Calcination of Catalyst

For calcination of the catalyst, an electric oven, controlled at a set temperature within ±5° C., was used. The catalyst was placed and dried in the electric oven set at 150° C. After drying, the temperature was raised at a rate of 100° C./hour to a predetermined calcination temperature. After the temperature was raised, calcination was done at the calcination temperature for 8 hours. After cooling, the resulting catalyst was used for the reaction.

(c) Reaction Test

The catalyst was packed in a cylindrical pressure-resistant vessel to prepare a cylindrical catalyst bed of 40 mm in diameter, 200 mm in length and 250 ml in volume. The vessel was covered with a lagging material having a thickness of 1.5 cm and placed in the constant temperature bath which was controlled to a set temperature within ±1° C. An alkylbenzene-styrene mixture was continuously fed to the catalyst bed by means of a constant-flow pump, and the reactor effluent was cooled and collected in a pressure receiver which was pressurized to 7 $Kg/cm^2$ with nitrogen. The reactor effluent (material for distillation) was discharged at predetermined intervals, and the product was separated by distillation. Results of the distillation for each component are shown in terms of the average composition in 10 days from initiation of the reaction, unless otherwise indicated.

(d) Solvent Preparation A

The following procedures were carried out in accordance with the foregoing Procedures (a) to (c) of this Example 4.

A fraction of distillation temperatures of 135° C. to 198° C. was separated from the by-product oil in the thermal cracking of naphtha. Composition of this raw material fraction was: saturated aliphatics 3.6% by weight, aromatics (excluding styrenes) 62.2% by weight and unsaturated hydrocarbons 34.2% by weight (including styrenes of 32.2% by weight).

The reactant was prepared by mixing 3 parts by weight of xylene with 1 part by weight of the above fraction, thereby reducing the styrene content to 8.05% by weight. The feeding rate was 250 ml/hr, the reaction temperature 150° C. and the catalyst $Al_2O_3$-40 that was calcined at 550° C. for 8 hours. The results are shown in the following Table 3.

(e) Solvent Preparation B

The following procedures were carried out in accordance with the foregoing Procedures (a) to (c) of Example 4.

A raw material fraction having distillation temperature of 135° C. to 145° C. was separated by distillation from the by-product oil obtained in the thermal cracking of naphtha. Composition of the raw material fraction is shown in the following Table 2. The catalyst used was $Al_2O_3$-28 which was calcined at 550° C. for 8 hours.

TABLE 2

| Components | Contents |
|---|---|
| Non-aromatics | 3.7% by weight |
| Toluene | 0.1% by weight |
| Ethylbenzene | 9.6% by weight |
| p-Xylene | 19.2% by weight |
| m-Xylene | 27.8% by weight |
| o-Xylene | 10.6% by weight |
| Styrene | 28.8% by weight |
| Cumene | 0.2% by weight |

The reactant was prepared by mixing 3 parts by weight of xylene with 1 part by weight of the above raw material fraction, thereby reducing the styrene content to 7.2% by weight. The conditions, excepting the above raw material fraction and the catalyst, were the same as those of the above Procedure (d), Solvent Preparation A. The results are also shown in Table 3.

TABLE 3

| Solvent Preparation | A | B |
|---|---|---|
| Material for distillation (g) | 3000 | 3000 |
| Fraction 1 (g) | 330.0 | 314.1 |
| (Boiling temp. conv'd. to atm. press., °C.) | (290–315) | (290–305) |
| Fraction 2 (g) | 79.4 | 78.3 |
| (Boiling temp. conv'd. to atm. press., °C.) | (340–395) | (340–380) |

TABLE 3-continued

| Solvent Preparation | A | B |
|---|---|---|
| Bottom residue (g) | 38.5 | 8.6 |

(f) Tests for Pressure-Sensitive Recording Material

In place of the solvent used in Example 1, the fractions 1 obtained in the Solvent Preparations A and B were used. The toxicity, odor, hue, dissolving power to dyestuffs and stability of solution of these fractions were satisfactory. The microcapsules were prepared similar to Procedures (b) and (c) of Example 1, and some sheets of recording paper were prepared. The sheets of recording paper were put together in layers, and duplication was carried out using a ballpoint pen. A clear duplicate without any run was obtained.

Comparative Example 1

The microcapsule preparation was carried out as in Procedures (b) and (c) of Example 1, in which 2,4-dimethyl diphenylmethane was used as a solvent and C.V.L. as a dyestuff. Recording paper was then prepared using the above obtained microcapsules. The odor of the above solvent was worse than those of Examples 1 to 4. According to the accelerated fading tests on duplicated images, the rate of fading was 20 to 24% in this Example, while those of Examples 1 to 4 were 14% or less.

Comparative Example 2

Dimethyl diphenylmethane (ditolylmethane) was used as a solvent and C.V.L. was used as a dyestuff. The above solvent had a worse odor compared with those of Examples 1 to 4. In addition, the dissolving power to the dyestuff was so low that only 0.8% by weight of C.V.L. was dissolved. Recording paper was prepared by producing microcapsules in the same manner as Procedures (b) and (c) of Example 1. The accelerated fading tests were carried out. As the result, the reduction rate of color density after irradiation was 20 to 24%.

Comparative Example 3

In connection with the solvents that were used in Example 1 and Comparative Example 1, biochemical decomposition tests were carried out.

The activated sludge (activated sludge concentration: about 10,000 ppm) obtained from Yokohama Middle Sewage Disposal Plant was used as the treating agent. 1% of this activated sludge was added to 50 ml of culture medium containing 200 ppm of a solvent. Using a 500 ml shaking flask, the mixture was cultured at 25° C. for 11 days. After the above incubation, the solvent of Example 1 was completely decomposed, while the solvent of Comparative Example 1 had not decomposed completely, 135 ppm of the solvent remaining (rate of biochemical decomposition: 32.5%).

From the above Comparative Examples 1 to 3, it will be understood that the solvent of the present invention is quite advantageous.

Although the present invention has been described in connection with preferred examples thereof, many variations and modifications will now become apparent to those skilled in the art. It is preferred, therefore, that the present invention be limited not by the specific disclosure herein but only by the appended claims.

What is claimed is:

1. A method of producing pressure-sensitive recording material wherein a sheet material is coated with pressure rupturable microcapsules containing therein a solution of dyestuff in a solvent fraction, the main components of which are chosen from the group consisting of non-condensed bicyclic and tricyclic aromatic hydrocarbons, having a boiling range (converted to atm. press.) of 265° to 360° C., which comprises treating a raw material fraction in the presence of an acid catalyst and under the conditions of liquid phase, 0.1 to 5 hours in contact time, and 10% by weight or less in concentration of monocyclic aromatic olefins contained in the material fed to the reaction vessel, said raw material fraction being obtained from the product of thermal cracking of petroleum hydrocarbons at a temperature of 700° C. or above and mainly containing the distillate having boiling points in the range of 75° C. to 198° C. and the main components thereof being monocyclic aromatic hydrocarbons (excluding aromatic olefins) each having 6–10 carbon atoms and monocyclic aromatic olefins.

2. The method claimed in claim 1, wherein the molar ratio of said monocyclic aromatic hydrocarbons (excluding aromatic olefins) to said monocyclic aromatic olefins contained in said raw material fraction is 1:0.05–1:1.

3. The method claimed in claim 2, wherein said treatment in the presence of a catalyst is carried out by continuously feeding said raw material fraction in the liquid state to a catalyst bed of synthetic silica-alumina at a temperature of 100° C. to 200° C., said synthetic silica-alumina containing 20% to 50% by weight of alumina and having been calcined at a temperature in the range of 450° C. to 600° C.

4. The method claimed in claim 1, wherein said treatment in the presence of catalyst is carried out by continuously feeding said raw material fraction in liquid state to a catalyst bed of synthetic silica-alumina at a temperature of 100° C. to 200° C., said synthetic silica-alumina containing 20% to 50% by weight of alumina and having been calcined at a temperature in the range of 450° C. to 600° C.

5. The method claimed in claim 1, wherein said raw material fraction substantially comprises the components in the boiling range of 105° C. to 180° C.

6. The method claimed in claim 5, wherein said condition of 10% by weight or less in the concentration of monocyclic aromatic olefins is attained by adding at least one member selected from the group of materials to said raw material fraction, said group of materials consisting of: (a) the catalyst-treated fraction, (b) the fraction having the same boiling range as that of said raw material fraction which is recovered from said catalyst-treated fraction and (c) one or more compounds which are the same as the monocyclic aromatic components (excluding aromatic olefins) contained in said raw material fraction or said catalyst-treated fraction.

7. The method claimed in claim 1, wherein said raw material fraction substantially comprises the components in the boiling range of 135° C. to 160° C.

8. The method claimed in claim 1, wherein said solvent fraction contains as the main components non-condensed bicyclic aromatic hydrocarbons.

9. The method claimed in claim 1, wherein said condition of 10% by weight or less in the concentration of monocyclic aromatic olefins is attained by adding at least one member selected from the group of materials to said raw material fraction, said group of materials consisting of: (a) the catalyst-treated fraction, (b) the fraction having the same boiling range as that of said raw material fraction which is recovered from said catalyst-treated fraction and (c) one or more compounds which are the same as the monocyclic aromatic components (excluding aromatic olefins) contained in said raw material fraction or said catalyst-treated fraction.

10. The method claimed in claim 1, wherein said solvent fraction substantially comprises the components having boiling points (converted to atmospheric pressure) in the range of 275° C. to 315° C.

11. The method claimed in claim 1, wherein the main components of said raw material fraction further comprises 5 to 15 weight percent of saturated aliphatic hydrocarbons and 2 to 10 weight percent of monocyclic aromatic olefins.

12. The method claimed in claim 11, wherein said treatment in the presence of catalyst is carried out by continuously feeding said raw material fraction in the liquid state to a catalyst bed of synthetic silica-alumina at a temperature of 100° C. to 200° C., said synthetic silica-alumina containing 20% to 50% by weight of alumina and having been calcined at a temperature in the range of 450° C. to 600° C.

* * * * *